US007504916B2

(12) United States Patent
Masaki

(10) Patent No.: US 7,504,916 B2
(45) Date of Patent: Mar. 17, 2009

(54) SOLENOID SWITCH HAVING MOVING CONTACT CONFIGURED TO PREVENT CONTACT BOUNCE

(75) Inventor: Kazuo Masaki, Chita (JP)

(73) Assignee: Denso Corporation, Kariya (JP)

( * ) Notice: Subject to any disclaimer, the term of this patent is extended or adjusted under 35 U.S.C. 154(b) by 25 days.

(21) Appl. No.: 11/526,578

(22) Filed: Sep. 26, 2006

(65) Prior Publication Data

US 2007/0069840 A1 Mar. 29, 2007

(30) Foreign Application Priority Data

Sep. 26, 2005 (JP) ..... 2005-278083

(51) Int. Cl.
*H01H 67/02* (2006.01)

(52) U.S. Cl. ..... 335/126; 335/104; 335/131; 335/193; 335/271; 335/277

(58) Field of Classification Search ..... 335/104, 335/126, 193, 271, 277
See application file for complete search history.

(56) References Cited

U.S. PATENT DOCUMENTS 3,472,984 A * 10/1969 Cusick ..... 200/288
4,063,204 A * 12/1977 McFarlin ..... 335/193
4,381,491 A * 4/1983 Vogelgesang ..... 335/257
4,706,037 A * 11/1987 Prouty et al. ..... 335/248
4,801,909 A * 1/1989 Fasola ..... 335/126
5,256,992 A * 10/1993 Fasola et al. ..... 335/126
5,359,842 A * 11/1994 Braxmeier et al. ..... 57/132
6,486,762 B2 * 11/2002 Kurasawa et al. ..... 335/278
2007/0194867 A1 * 8/2007 Kurasawa et al. ..... 335/126

FOREIGN PATENT DOCUMENTS

JP A 9-161639 6/1997
JP A 2001-107828 4/2001

* cited by examiner

*Primary Examiner*—Elvin G Enad
*Assistant Examiner*—Mohamad A Musleh
(74) *Attorney, Agent, or Firm*—Oliff & Berridge, PLC

(57) ABSTRACT

According to the present invention, there is provided a solenoid switch which includes a pair of fixed contacts spaced away from each other, a solenoid, a contact pressure applier, and a moving contact. The moving contact is configured to be moved by the solenoid to strike the fixed contacts and keep contact with the fixed contacts under pressure applied by the contact pressure applier, thereby bridging the fixed contacts. The moving contact is also configured to have, when striking the fixed contacts, a flexural rigidity lower than or equal to 1000 N/mm, thereby preventing contact bounce from occurring in the solenoid switch.

7 Claims, 4 Drawing Sheets

SOLENOID SWITCH HAVING MOVING CONTACT CONFIGURED TO PREVENT CONTACT BOUNCE

CROSS-REFERENCE TO RELATED APPLICATION

This application is based on and claims priority from Japanese Patent Application No. 2005-278083, filed on Sep. 26, 2005, the content of which is hereby incorporated by reference into this application.

BACKGROUND OF THE INVENTION

1. Technical Field of the Invention

The present invention relates generally to solenoid switches or electromagnetic switches. More particularly, the invention relates to a solenoid switch for an engine starter, which includes a moving contact configured to prevent contact bounce from occurring during operation of the solenoid switch.

2. Description of the Related Art

There is known a solenoid switch for closing and opening a motor circuit of an engine starter. The solenoid switch includes a pair of fixed contacts, which are included in the motor circuit as main contacts, a moving contact working to connect and disconnect the fixed contacts, and a solenoid working to actuate the moving contact.

In such a solenoid switch, when the moving contact is moved by the solenoid to strike the fixed contacts, the moving contact will bounce in the opposite direction to the striking due to the reaction force of the fixed contacts. The striking and bouncing may repeat several times until establishment of a stable contact between the moving contact and the fixed contacts, thus causing the so-called contact bounce. As a consequence, the moving and fixed contacts may be quickly worn down due to large-current arc discharge, and in the worst case, they may be welded to adhere together.

To suppress occurrence of contact bounce, Japanese Patent First Publication No. 2001-107828 discloses a first approach, according to which the attracted motion of a plunger is slowed down by an air-damping effect, thereby reducing the impact load generated during the striking of the moving contact against the fixed contacts.

However, with the first approach, it is difficult to reliably suppress occurrence of contact bounce when the solenoid switch is used for an automotive engine starter. More specifically, the temperature in an automobile generally changes largely, and the air-damping effect depends on the temperature. Accordingly, it is difficult to secure the stability of the air-damping effect.

For the same purpose, Japanese Patent First Publication No. H09-161639 discloses a second approach, according to which the center of gravity of the moving contact and the center of gravity of a contact pressure spring are oppositely deviated from a center line, thereby producing an angular moment to damp the movement of the moving contact.

However, with the second approach, it is still difficult to reliably suppress occurrence of contact bounce when the solenoid switch is used for an automotive engine starter. More specially, there are often produced high vibrations in an automobile, and thus the behavior of the moving contact and the contact pressure spring, the centers of gravity of which are oppositely deviated, tends to become unstable. Accordingly, it is difficult to reliably damp the movement of the moving contact.

SUMMARY OF THE INVENTION

The present invention has been made in view of the above-mentioned problems.

It is, therefore, a primary object of the present invention to provide a solenoid switch that can reliably prevent contact bounce from occurring therein regardless of ambient temperature and vibrations.

According to the present invention, there is provided a solenoid switch which includes a pair of fixed contacts spaced away from each other, a solenoid, a contact pressure applier, and a moving contact.

The moving contact is configured to be moved by the solenoid to strike the fixed contacts and keep contact with the fixed contacts under pressure applied by the contact pressure applier, thereby bridging the fixed contacts. The moving contact is also configured to have, when striking the fixed contacts, a flexural rigidity lower than or equal to 1000 N/mm.

The impact load generated during the striking of the moving contact against the fixed contacts is proportional to the square root of the flexural rigidity of the moving contact. Therefore, the impact load can be decreased by decreasing the flexural rigidity of the moving contact. Further, with the decrease in the impact load, the reaction force of the fixed contacts applied on the moving contact in the direction to move the moving contact away from the fixed contacts also decreases, thereby suppressing occurrence of contact bounce in the solenoid switch.

Accordingly, specifying the flexural rigidity of the moving contact as above, it is possible to effectively suppress occurrence of contact bounce in the solenoid switch.

Consequently, the moving and fixed contacts can be reliably prevented from being quickly worn down due to arc discharge, thus securing a long service life thereof. At the same time, the moving and fixed contacts can also be reliably prevented from being welded to adhere together.

Further, the flexural rigidity of the moving contact is hardly affected by ambient temperature and vibrations. Accordingly, the solenoid switch can reliably prevent contact bounce from occurring therein regardless of ambient temperature and vibrations.

It is preferable that the moving contact has, when striking the fixed contacts, a flexural rigidity lower than or equal to 800 N/mm.

It is more preferable that the moving contact has, when striking the fixed contacts, a flexural rigidity lower than or equal to 650 N/mm.

It is also preferable that in the solenoid switch, $F1 \geqq P1$, where F1 represents a pressing force of the contact pressure applier applied on the moving contact when the moving contact strikes the fixed contacts, and P1 represents a maximum reaction force of the fixed contacts applied on the moving contact in a direction to move the moving contact away from the fixed contacts during the striking of the moving contact against the fixed contacts.

Specifying F1 to be greater than or equal to P1, it is possible to overbear the tendency of the moving contact to get away from the fixed contacts due to the impact load generated during the striking of the moving contact against the fixed contacts, with the pressing force of the contact pressure applier. Consequently, it becomes possible to more reliably prevent contact bounce from occurring in the solenoid switch.

According to a further implementation of the present invention, the solenoid of the solenoid switch includes: an iron core; a field winding wound around the iron core to form an electromagnet; a plunger disposed to have a gap with the iron core, the plunger being configured to be moved by magnetic attraction of the electromagnet when the field winding is energized; and a shaft configured to transmit the movement of the plunger to the moving contact, thereby causing the moving contact to strike the fixed contacts.

Further, it is preferable that in the above solenoid switch, F2≧P2, where F2 represents a pressing force of the contact pressure applier applied on the moving contact when the plunger strikes the iron core after the striking of the moving contact against the fixed contacts, and P2 represents a maximum reaction force of the fixed contacts applied on the moving contact in a direction to move the moving contact away from the fixed contacts during the striking of the plunger against the iron core.

Specifying F2 to be greater than or equal to P2, it is possible to overbear the tendency of the moving contact to get away from the fixed contacts due to the impact load generated during the striking of the plunger against the iron core, with the pressing force of the contact pressure applier.

Consequently, it becomes possible to more reliably prevent contact bounce from occurring in the solenoid switch.

Preferably, in the solenoid switch, the moving contact is configured to strike and keep contact with the most outer part of each of the fixed contacts.

With such a configuration, the contact area between the moving contact and the fixed contacts is maximized, so that wear of the moving and fixed contacts can be minimized, thereby prolonging the service life thereof. At the same time, the flexure span of the moving contact during the striking of the moving contact against the fixed contacts is also maximized, thereby further lowering the flexure rigidity of the moving contact.

In the solenoid switch, the contact pressure applier may be made up of a springing arranged between the solenoid and the moving contact.

The solenoid switch according to the present invention is particularly advantageous when used for an engine starter, more specifically, when the fixed contacts thereof are included in a motor circuit of the engine starter as main contacts.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
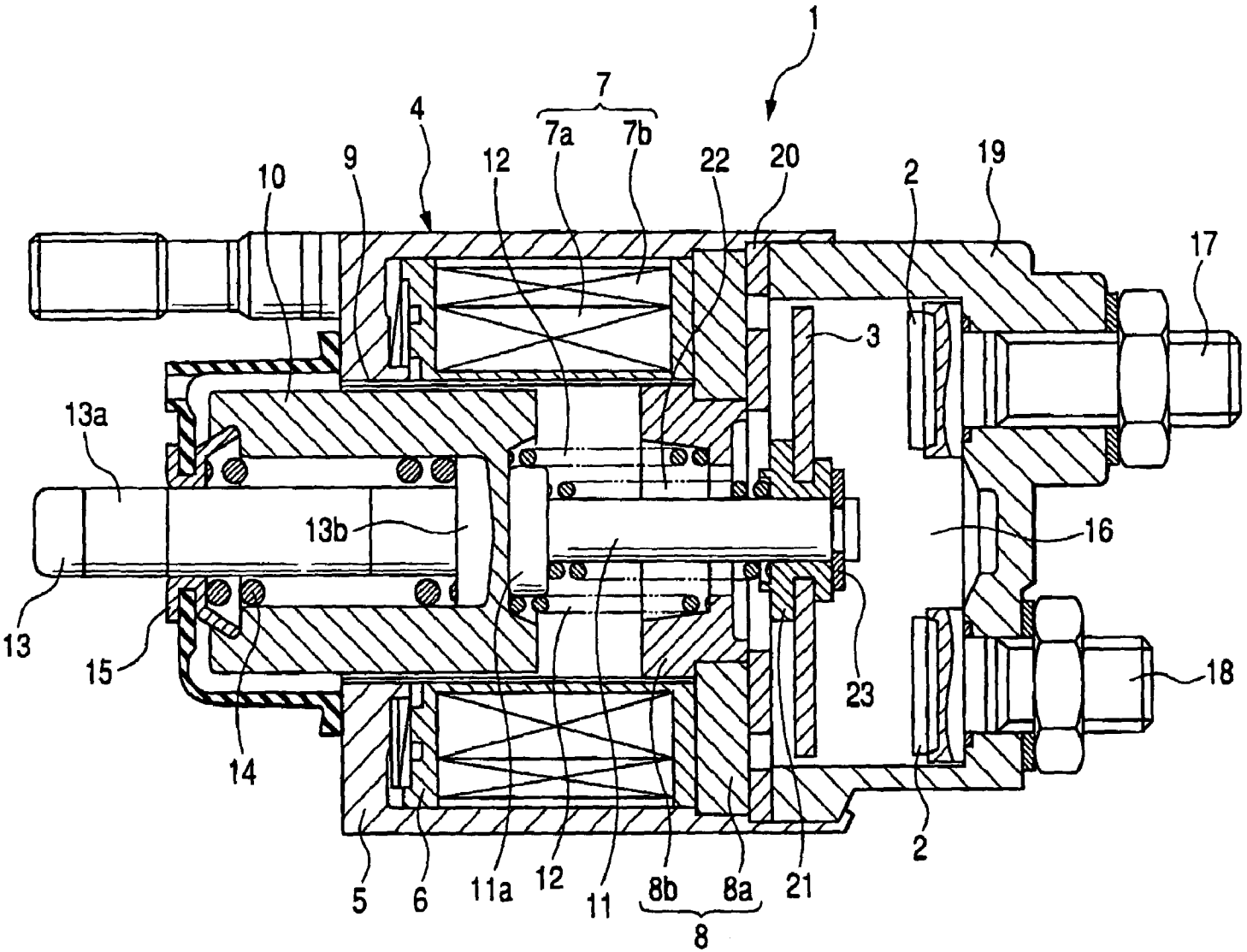
FIG. 1 is a partially cross-sectional side view showing the overall structure of a solenoid switch according to the first embodiment of the invention.
Figure 2:
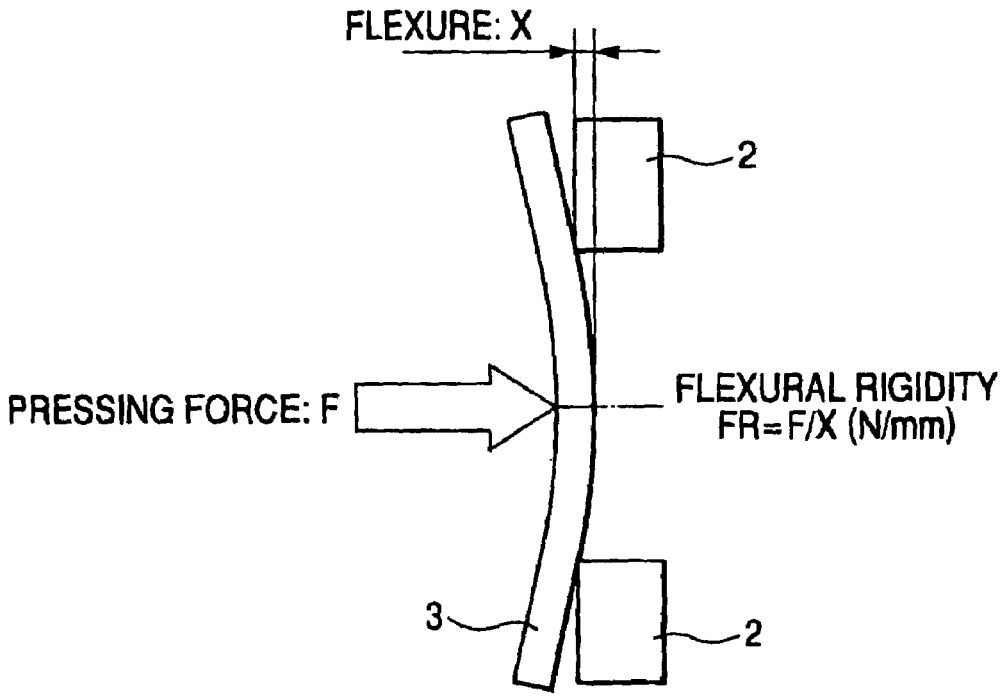
FIG. 2 is a schematic diagram illustrating the flexure of a moving contact during the striking of the moving contact against fixed contacts in the solenoid switch of FIG. 1.

The preferred embodiments of the present invention will be described hereinafter with reference to FIGS. 1-6.

It should be noted that, for the sake of clarity and understanding, identical components having identical functions in different embodiments of the invention have been marked, where possible, with the same reference numerals in each of the figures.

First Embodiment

FIG. 1 shows the overall structure of a solenoid switch 1 according to the first embodiment of the invention, which is designed to close and open, for example, a motor circuit of an automotive engine starter.

As shown in FIG. 1, the solenoid switch 1 includes a pair of fixed contacts 2 spaced away from each other, which make up the main contacts of the motor circuit, a moving contact 3 working to connect and disconnect the fixed contacts 2, and a solenoid 4 working to actuate the moving contact 3 to make contact with and get away from the fixed contacts 2.

The solenoid 4 includes a cup-shaped yoke 5, a bobbin 6 accommodated in the yoke 5, a field winding 7 wound around the bobbin 6, an iron core 8 to be magnetized upon energizing the field winding 7, a plunger 10 inserted in the bobbin 6 via a sleeve 9, and a shaft 11 working to transmit motion of the plunger 10 to the moving contact 3.

The yoke 5 serves as the outer frame of the solenoid 4 and works to form a magnetic circuit around the field winding 7 in cooperation with the iron core 8.

The field winding 7 consists of a pull-in winding 7*a* and a hold winding 7*b*. The pull-in winding 7*a* woks to create magnetic attraction for attracting the plunger 10. On the other hand, the hold winding 7*b* works to create magnetic attraction for holing the attracted plunger 10 in place. The pull-in winding 7*a* and the hold winding 7*b* are wound around the bobbin 6 in a two-layer form.

The iron core 8 consists of an outer iron core 8*a* and an inner iron core 8*b*. The outer iron core 8*a* is annular in shape and disposed close to the open end of the yoke 5. The inner iron core 8*b* is also annular in shape and disposed on the inner periphery of the outer iron core 8*a*.

The plunger 10 is disposed inside the sleeve 9 to face the inner iron core 8*b* in the longitudinal direction of the solenoid switch 1. Between the plunger 10 and the inner iron core 8*b*, there is arranged a return spring 12 that urges the plunger 10 in the direction away from the inner iron core 8*b* (i.e., the leftward direction of FIG. 1), thereby keeping a predetermined gap between the plunger 10 and the inner iron core 8*b*.

Further, the plunger 10 has a recess formed on the opposite side to the inner iron core 8*b*, in which are inserted a lever-actuating rod 13 and a lever spring 14.

The lever-actuating rod 13 has formed, on an end portion thereof protruding from the recess of the plunger 10, an engagement groove 13*a* with which a shift lever of the engine starter engages.

The lever spring 14 is arranged, around the lever-actuating rod 13, between a collar 15 disposed at the open end of the recess of the plunger 10 and a brim portion 13*b* of the lever-actuating rod 13 abutting the bottom end of the recess of the plunger 10. The lever spring 14 presses the brim portion 13*b* of the lever-actuating rod 13 to the bottom end of the recess of the plunger 10.

The shaft 11 has a flange portion 11*a* at a base end thereof. The flange portion 11*a* is fixed to an end face of the plunger 10, thus making the shaft 11 movable along with the plunger 10. On the other hand, a distal end of the shaft 11 projects, through the inner space of the inner iron core 8*b*, into a contact chamber 16 in which the fixed contacts 2 and the moving contact 3 are accommodated.

The fixed contacts 2 are connected to the motor circuit of the engine starter via the terminal studs 17 and 18, respectively. The fixed contacts 2 are located inside a contact cover 19 to which the terminal studs 17 and 18 are fastened.

The contact cover 19 is made, for example, of a resin material by molding. As can be seen from FIG. 1, the contact cover 19 is joined, via a rubber packing 20, to an end face of the iron core 8 by crimping an open end of the yoke 5 inwardly.

The moving contact 3 is supported, via an insulator 21, by the shaft 11 such that the moving contact 3 is movable relative to the shaft 11 in the axial direction of the shaft 11.

A contact pressure spring 22 is arranged, around the shaft 11, between the flange portion 11*a* of the shaft and the insulator 21. The contact pressure spring 22 urges the moving contact 3 as well as the insulator 21 in the direction from the base end to the distal end of the shaft 11 (i.e., in the rightward direction of FIG. 1). Moreover, a stopper (e.g., a washer) 23 is provided at the distal end of the shaft 11 to stop the moving contact 3 from being detached from the shaft 11.

In addition, the gap (or the distance) between the moving contact 3 and the fixed contacts 2 in the axial direction of the shaft 11 is set to be less than the gap between the plunger 10 and the inner iron core 8*b* in the same direction.

The moving contact 3 is made, preferably, of copper (Cu) or a copper alloy. Moreover, in the present embodiment, the moving contact 3 is specified to have, when striking the fixed contacts 2, a flexural rigidity FR lower than or equal to 1000 N/mm. The flexural rigidity FR can be determined, referring to FIG. 2, by the following equation:

$$FR=F/X(N/\text{mm}) \quad (1),$$

where F represents the pressing force on the moving contact 3, and X represents the flexure of the moving contact 3 due to the pressing force.

After having described the overall structure of the solenoid switch 1 according to the present embodiment, operation thereof will be described hereafter.

When the field winding 7 is energized upon turning on an ignition switch (not shown) or pressing a start button (not shown), the electromagnet formed by the field winding 7 and the iron core 8 attracts the plunger 10 to move toward the inner iron core 8*b* against the spring force of the return spring 12. With the movement of the plunger 10, the shaft 11 is deeply pushed into the contact chamber 16, causing the moving contact 3 to strike the fixed contacts 2. After that, the plunger 10 further moves toward the inner iron core 8*b* against the spring force of both the return spring 12 and the contact pressure spring 22, until it strikes the inner iron core 8*b*.

Thus, after striking the fixed contacts 2, the moving contact 3 keeps contact with the fixed contacts 2 under pressure applied by the contact pressure spring 22, thereby bridging the fixed contacts 2.

Consequently, the motor circuit of the engine starter is closed, and the starter motor is supplied with electric current from a battery (not shown) to start the engine.

As soon as the engine has started, the field winding 7 is deenergized, causing the magnetic attraction of the electromagnet to disappear. Then, the plunger 10 is returned to the initial position thereof, at which the plunger 10 has the predetermined gap with the inner iron core 8*b*, by the spring force of the return spring 12. With the returning movement of the plunger 10, the shaft 11 is pulled out from the contact chamber 16, leaving only the distal end thereof in the contact chamber 16. Consequently, the moving contact 3 gets away from the fixed contacts 2, so that the motor circuit of the engine starter is opened, and the electric current supply to the starter motor is shut off.

As described above, in the solenoid switch 1 according to the present embodiment, the moving contact 3 is specified to have, when striking the fixed contacts 2, the flexural rigidity FR lower than or equal to 1000 N/mm.

In theory, the impact load generated during the striking of the moving contact 3 against the fixed contacts 2 is proportional to the square root of the flexural rigidity FR of the moving contact 3. Therefore, the impact load can be decreased by decreasing the flexural rigidity FR.

Further, with the decrease in the impact load, the reaction force of the fixed contacts 2 applied on the moving contact 3 in the direction to move the moving contact 3 away from the fixed contacts 2 also decreases, thereby suppressing occurrence of contact bounce in the solenoid switch 1.

Accordingly, specifying the flexural rigidity FR of the moving contact 3 as above, it is possible to effectively suppress occurrence of contact bounce in the solenoid switch 1.

Consequently, the moving contact 3 and the fixed contacts 2 can be reliably prevented from being quickly worn down due to arc discharge, thus securing a long service life thereof. At the same time, the moving contact 3 and the fixed contacts 2 can also be reliably prevented from being welded to adhere together.

Further, the flexural rigidity FR of the moving contact 3 is hardly affected by ambient temperature and vibrations. Therefore, even when mounted on an automobile, where the temperature changes largely and high vibrations occur, it is still possible for the solenoid switch 1 to reliably prevent contact bounce from occurring therein.

Figure 3:
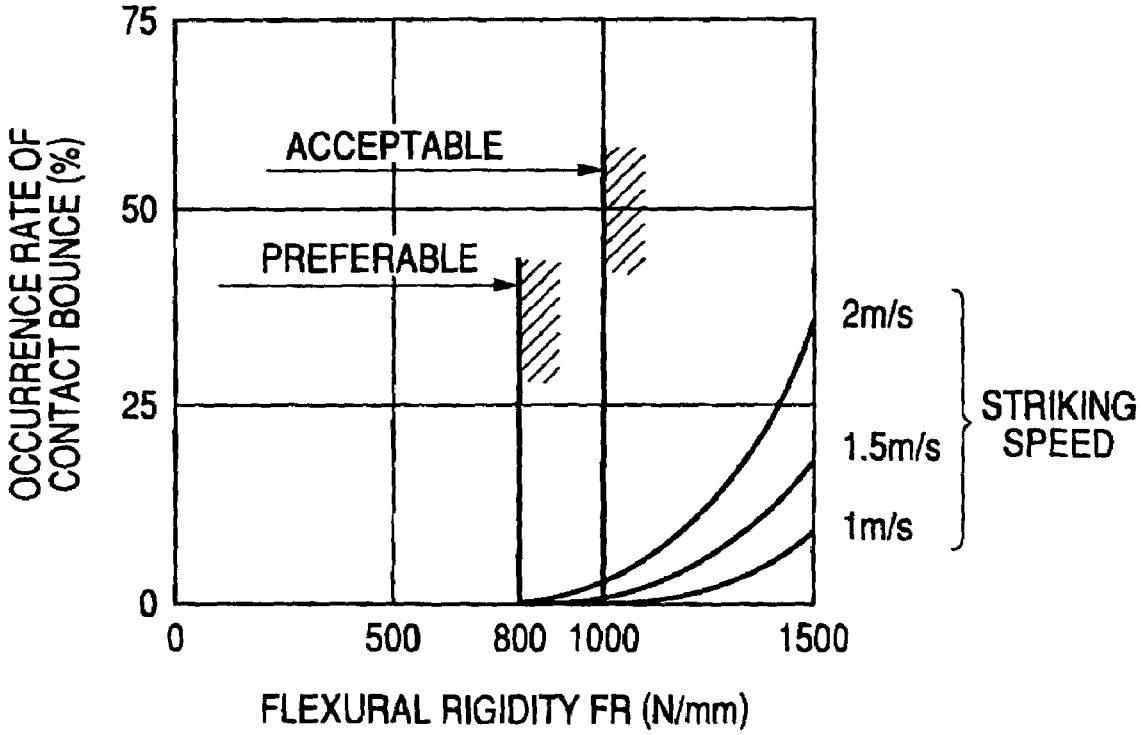
FIG. 3 is a graph showing the relationship between the flexural rigidity of the moving contact and the occurrence rate of contact bounce in the solenoid switch of FIG. 1.

FIG. 3 shows the results of an experimental investigation conducted by the inventor of the present invention.

As shown in FIG. 3, with the striking speed (i.e., the speed of the moving contact 3 when it strikes the fixed contacts 2) of 1.5 m/s, the occurrence rate of contact bounce was zero when the flexural rigidity FR of the moving contact 3 was lower than or equal to 1000 N/mm.

However, with the striking speed of 2 m/s, contact bounce occurred in the rate of several percent when the flexural rigidity FR of the moving contact 3 was equal to 1000 N/mm. That is, the occurrence rate of contact bounce increased with increase in the striking speed.

Further, with the striking speed of 2 m/s, contact bounce was completely prevented from occurring when the flexural rigidity FR of the moving contact 3 was lowered to 800 N/m.

In solenoid switches for automotive engine starters, the striking speed is usually in the range of 1 to 2 m/s. Accordingly, it is preferable that the moving contact 3 has, when striking the fixed contacts 2, the flexural rigidity FR lower than or equal to 800 N/mm.

Furthermore, considering possible variations in the striking speed, it is more preferable that the moving contact 3 has, when striking the fixed contacts 2, the flexural rigidity FR lower than or equal to 650 N/mm.

Second Embodiment

This embodiment illustrates how to set the compressive load of the contact pressure spring 22 so as to more reliably prevent contact bounce from occurring in the solenoid switch 1.

As described previously, impact load will be generated when the moving contact 3 strikes the fixed contacts 2. The impact load acts on both the moving contact 3 and the fixed contacts 2.

Figure 4:
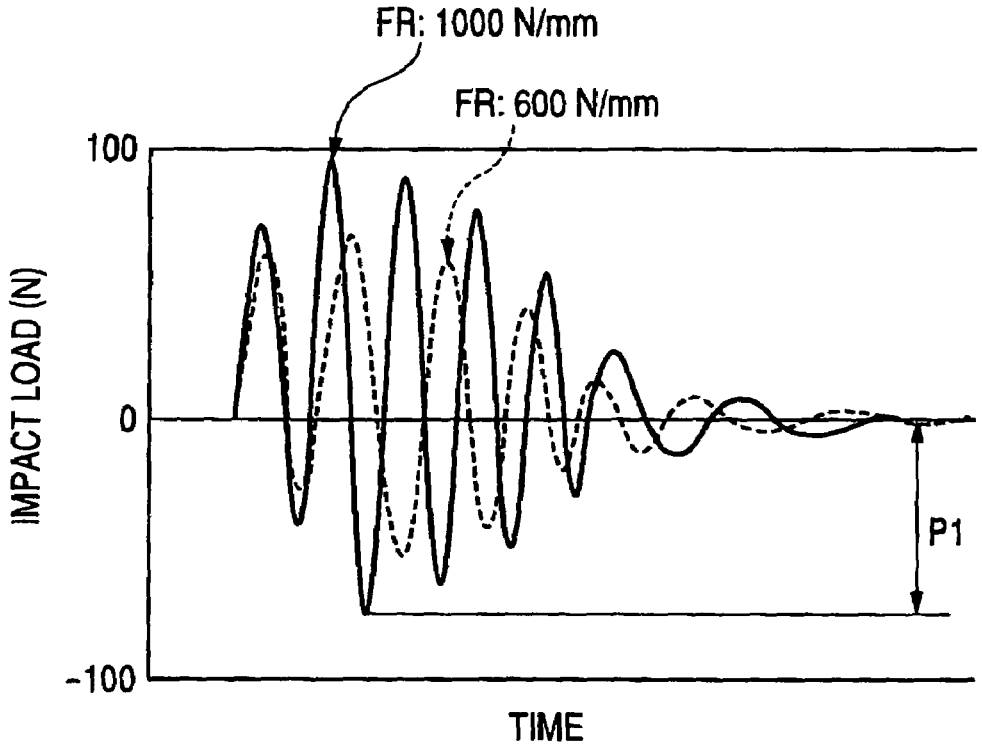
FIG. 4 is a graph showing the impact load acting on the moving contact during the striking of the moving contact against the fixed contacts in the solenoid switch of FIG. 1.

FIG. 4 shows the impact load acting on the moving contact 3 during the striking of the moving contact 3 against the fixed contacts 2. In the figure, the solid line represents the impact load generated when the flexural rigidity FR of the moving contact 3 is 1000 N/mm, while the dashed line represents that generated when the flexural rigidity FR is 600 N/m.

As shown in FIG. 4, with flexure of the moving contact 3, the impact load acts on the moving contact 3 in opposite directions alternately. More specifically, when the impact load acts in the first direction to press the moving contact 3 to the fixed contacts 2, the impact load has a positive value. On the contrary, when the impact load acts in second direction to move the moving contact 3 away from the fixed contacts 2, the impact load has a negative value. The positive impact load has no contribution to occurrence of contact bounce, but the negative impact load may cause the contact bounce to occur.

Accordingly, to more reliably prevent contact bounce from occurring in the solenoid switch 1, the compressive load of the contact pressure spring 22 is preferably so set as to satisfy the following equation:

$$F1 \geqq P1 \quad (2),$$

where F1 is the compressive load of the contact pressure spring 22 when the moving contact 3 strikes the fixed contacts 2, and P1 is the minimum value of the impact load (i.e., the negatively largest value as indicated in FIG. 4) generated during the striking.

In the above equation (2), F1 also represents the pressing force of the contact pressure spring 22 on the moving contact 3 when the moving contact 3 strikes the fixed contacts 2, and P1 also represents the maximum reaction force of the fixed contacts 2 applied on the moving contact 3 in the direction to move the moving contact 3 away from the fixed contacts 2 during the striking of the moving contact 3 against the fixed contacts 2.

Figure 5:
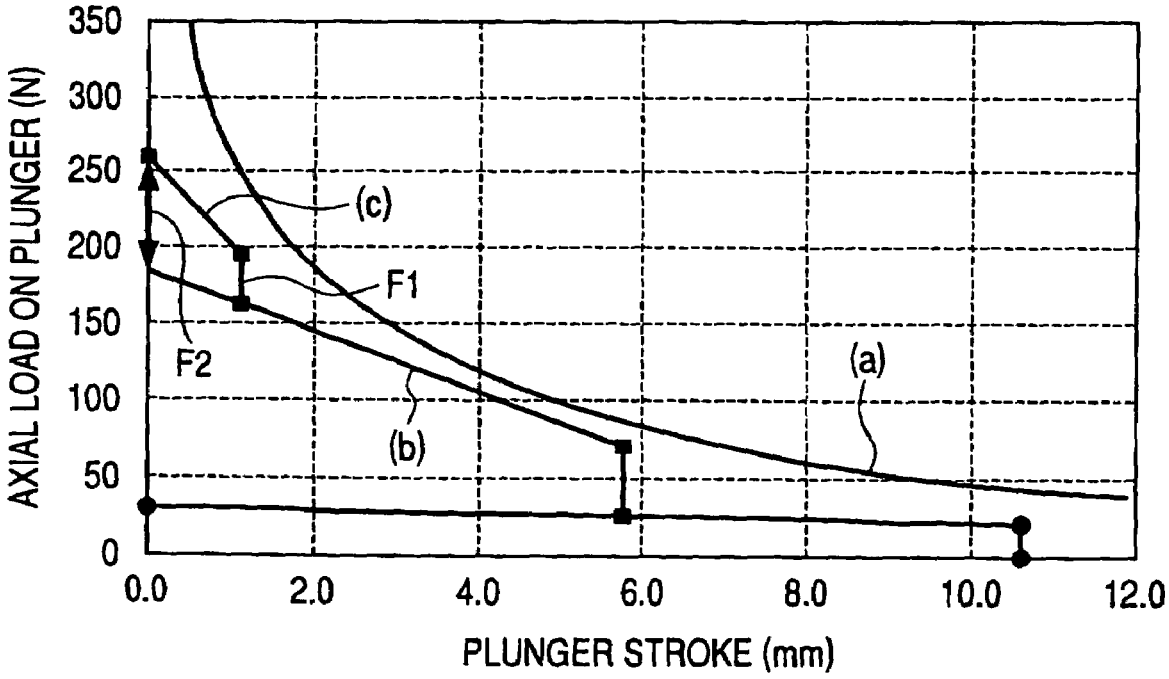
FIG. 5 is an operational characteristic diagram of the solenoid switch of FIG. 1.

In addition, F1 is illustrated in FIG. 5, where the curve (a) represents the magnetic attraction characteristic of the electromagnet, the curve (b) represents the load characteristic of the return spring 12, and the curve (c) represents the load characteristic of the contact pressure spring 22.

Specifying F1 to be greater than or equal to P1, it is possible to overbear the tendency of the moving contact 3 to get away from the fixed contacts 2 due to the impact load generated during the striking of the moving contact 3 against the fixed contacts 2, with the pressing force of the contact pressure spring 22.

Consequently, it becomes possible to more reliably prevent contact bounce from occurring in the solenoid switch 1.

Third Embodiment

In the solenoid switch 1, impact load is generated not only when the moving contact 3 strikes the fixed contacts 2, but also when the plunger 10 strikes the inner iron core 8*b* after the striking of the moving contact 3 against the fixed contacts 2.

This embodiment illustrates how to more suitably set the compressive load of the contact pressure spring 22 in consideration of the impact load generated during the striking of the plunger 10 against the inner iron core 8*b*.

The impact load generated during the striking of the plunger 10 against the inner iron core 8*b* will be transmitted to the moving contact 3 and the fixed contacts 2, via the shaft, the iron core 8, the contact cover 19, and so forth. As a consequence, the impact load will cause the fixed contacts 2 to exert a reaction force on the moving contact 3 in the direction to move the moving contact 3 away from the fixed contacts 2.

Accordingly, to more reliably prevent contact bounce from occurring in the solenoid switch 1, the compressive load of the contact pressure spring 22 is preferably so set as to satisfy the following equation:

$$F2 \geqq P2 \quad (3),$$

where F2 is the compressive load of the contact pressure spring 22 when the plunger 10 strikes the inner iron core 8*b*, and P2 is the maximum reaction force of the fixed contacts 2 applied on the moving contact 3 in the direction to move the moving contact 3 away from the fixed contacts 2 during the striking of the plunger 10 against the inner iron core 8*b*.

In the above equation (3), F2 also represents the pressing force of the contact pressure spring 22 on the moving contact 3 when the plunger 10 strikes the inner iron core 8*b*. In addition, F2 is also illustrated in FIG. 5.

Specifying F2 to be greater than or equal to P2, it is possible to overbear the tendency of the moving contact 3 to get away from the fixed contacts 2 due to the impact load generated during the striking of the plunger 10 against the inner iron core 8*b*, with the pressing force of the contact pressure spring 22.

Consequently, it becomes possible to more reliably prevent contact bounce from occurring in the solenoid switch 1.

Fourth Embodiment

This embodiment illustrates how to more suitably configure the moving contact 3 so as to more reliably prevent contact bounce from occurring in the solenoid switch 1.

Figure 6:
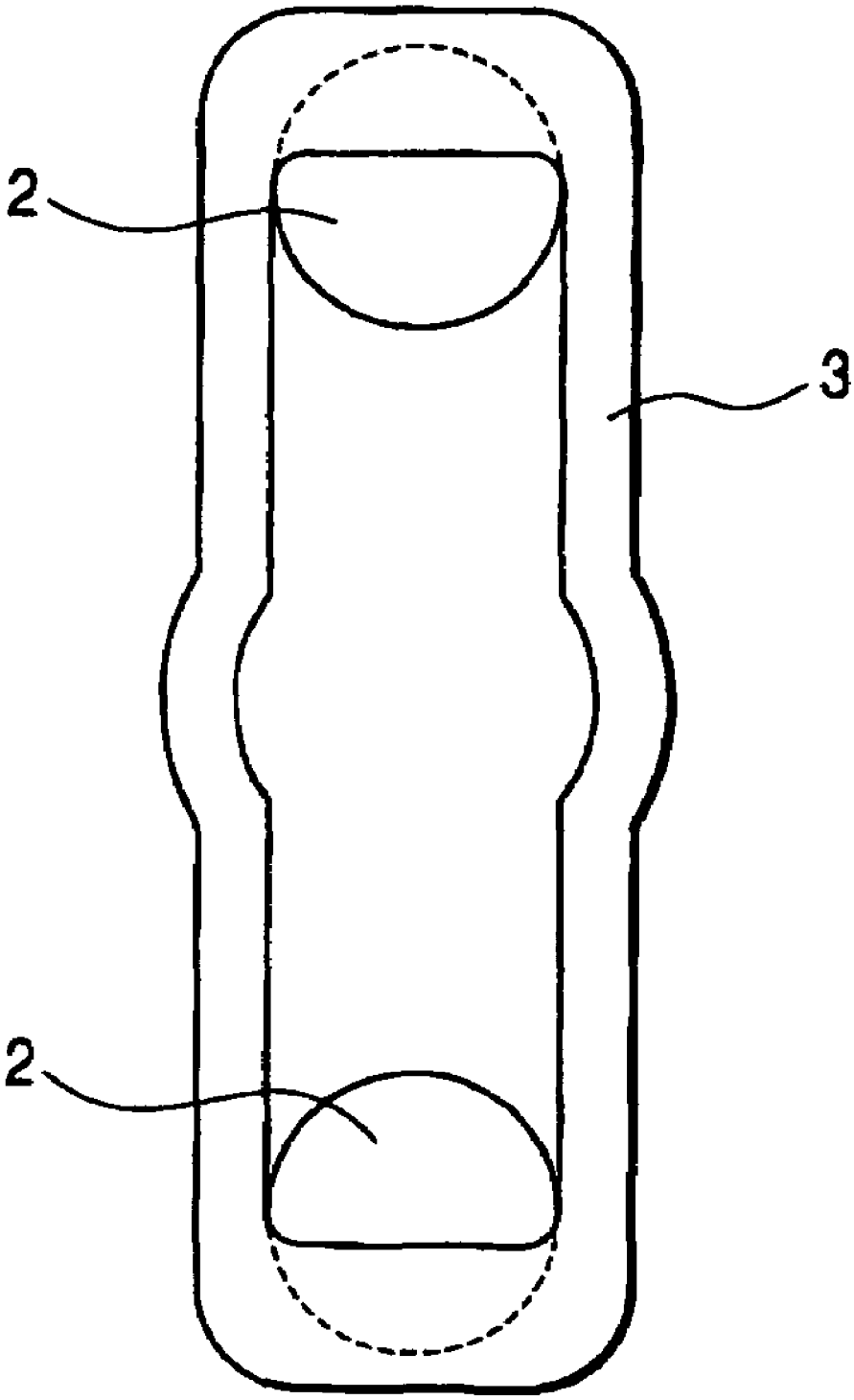
FIG. 6 is a side view showing a moving contact according to the fourth embodiment of the invention.

FIG. 6 shows a moving contact 3 according to the present embodiment, which has the central portion thereof punched out. In other words, the moving contact 3 according to the present embodiment has the shape of a hollow strip.

With such a hollow shape, the flexural rigidity of the moving contact 3 can be significantly lowered, without lowering the stability of the same against twist and inclination.

Further, with the above shape, the moving contact 3 will strike and keep contact with the most outer part of each of the fixed contacts 2.

Consequently, the contact area between the moving contact 3 and the fixed contacts 2 is maximized, so that wear of the moving contact 3 and the fixed contacts 2 can be minimized, thereby prolonging the service life thereof. At the same time, the flexure span of the moving contact 3 during the striking of the moving contact 3 against the fixed contacts 2 is also maximized, thereby further lowering the flexure rigidity of the moving contact 3.

While the above particular embodiments of the invention have been shown and described, it will be understood by those who practice the invention and those skilled in the art that various modifications, changes, and improvements may be made to the invention without departing from the spirit of the disclosed concept.

For example, in the fourth embodiment of the present invention, the moving contact 3 is configured to have a single large punched-out portion.

However, the moving contact 3 may also be configured to have two or more separate smaller punched-out portions to achieve the same purpose.

Such modifications, changes, and improvements within the skill of the art are intended to be covered by the appended claims.

What is claimed is:

1. A solenoid switch comprising:

a pair of fixed contacts spaced away from each other;

a solenoid;

a contact pressure applier; and a moving contact configured to be moved by the solenoid to strike the fixed contacts and keep contact with the fixed contacts under pressure applied by the contact pressure applier, thereby bridging the fixed contacts, the moving contact being also configured to have, when striking the fixed contacts, a flexural rigidity lower than or equal to 1000 N/mm, thereby preventing contact bounce from occurring in the solenoid switch, wherein the solenoid includes:

an iron core;

a field winding wound around the iron core to form an electromagnet;

a plunger disposed to have a gap with the iron core, the plunger being configured to be moved by magnetic attraction of the electromagnet when the field winding is energized; and a shaft fixed to the plunger and configured to transmit the movement of the plunger to the moving contact, thereby causing the moving contact to strike the fixed contacts, and wherein the moving contact has an outer edge protruding from a most outer part of each of the fixed contacts in a radial direction of the solenoid switch, and is configured to strike and keep contact with the most outer part of each of the fixed contacts.

2. The solenoid switch as set forth in claim 1, wherein the moving contact has, when striking the fixed contacts, a flexural rigidity lower than or equal to 800 N/mm.

3. The solenoid switch as set forth in claim 2, wherein the moving contact has, when striking the fixed contacts, a flexural rigidity lower than or equal to 650 N/mm.

4. The solenoid switch as set forth in claim 1, wherein $F1 \geqq P1$, where F1 represents a pressing force of the contact pressure applier applied on the moving contact when the moving contact strikes the fixed contacts, and P1 represents a maximum reaction force of the fixed contacts applied on the moving contact in a direction to move the moving contact away from the fixed contacts during the striking of the moving contact against the fixed contacts.

5. The solenoid switch as set forth in claim 1, wherein $F2 \geqq P2$, where F2 represents a pressing force of the contact pressure applier applied on the moving contact when the plunger strikes the iron core after the striking of the moving contact against the fixed contacts, and P2 represents a maximum reaction force of the fixed contacts applied on the moving contact in a direction to move the moving contact away from the fixed contacts during the striking of the plunger against the iron core.

6. The solenoid switch as set forth in claim 1, wherein the contact pressure applier is made up of a springing arranged between the solenoid and the moving contact.

7. The solenoid switch as set forth in claim 1, wherein the fixed contacts are configured to be included in a motor circuit of an engine starter as main contacts.

* * * * *